US008926481B2

(12) United States Patent
Moore

(10) Patent No.: US 8,926,481 B2
(45) Date of Patent: Jan. 6, 2015

(54) SAFETY DEVICE FOR LIFTING AND SUPPORTING BARBELLS

(71) Applicant: Glyn Moore, St. Catherines (CA)

(72) Inventor: Glyn Moore, St. Catherines (CA)

( * ) Notice: Subject to any disclaimer, the term of this patent is extended or adjusted under 35 U.S.C. 154(b) by 93 days.

(21) Appl. No.: 13/855,062

(22) Filed: Apr. 2, 2013

(65) Prior Publication Data

US 2013/0310228 A1 Nov. 21, 2013

Related U.S. Application Data

(60) Provisional application No. 61/620,237, filed on Apr. 4, 2012.

(51) Int. Cl.

| | |
|---|---|
| ***A63B 21/078*** | (2006.01) |
| ***A63B 21/06*** | (2006.01) |
| ***A63B 21/072*** | (2006.01) |
| ***A63B 71/00*** | (2006.01) |

(52) U.S. Cl.

CPC ..... *A63B 21/072* (2013.01); *A63B 71/0036* (2013.01); *A63B 21/0728* (2013.01); *A63B 21/0724* (2013.01)

USPC ..... 482/104; 482/94

(58) Field of Classification Search

CPC ..... A63B 21/078; A63B 2021/0786; A63B 2021/0783

USPC ..... 482/92–94, 104–108; D21/662, D21/679–683, 686

See application file for complete search history.

(56) References Cited

U.S. PATENT DOCUMENTS

| | | | | |
|---|---|---|---|---|
| 3,771,785 | A * | 11/1973 | Speyer | 482/106 |
| 3,825,253 | A * | 7/1974 | Speyer | 482/106 |
| 5,839,997 | A | 11/1998 | Roth et al. | |
| 5,954,619 | A * | 9/1999 | Petrone | 482/104 |
| 7,534,199 | B2 * | 5/2009 | Krull | 482/108 |
| D603,469 | S * | 11/2009 | Golesh et al. | D21/680 |
| 7,637,852 | B2 | 12/2009 | Hoole | |
| D610,636 | S | 2/2010 | Goelish et al. | |
| 7,674,208 | B2 | 3/2010 | Hoole | |
| D617,854 | S | 6/2010 | Gettle | |
| 8,740,760 | B2 * | 6/2014 | York et al. | 482/104 |
| 2006/0003874 | A1 * | 1/2006 | Hamilton | 482/93 |
| 2007/0197352 | A1 * | 8/2007 | Charniga et al. | 482/93 |
| 2008/0248930 | A1 * | 10/2008 | Hoole | 482/104 |
| 2009/0186748 | A1 * | 7/2009 | Golesh et al. | 482/107 |
| 2011/0183818 | A1 | 7/2011 | Mitchell et al. | |

FOREIGN PATENT DOCUMENTS

| | | | | |
|---|---|---|---|---|
| WO | WO 2004007030 | A1 * | 1/2004 | A63B 21/072 |

* cited by examiner

*Primary Examiner* — Oren Ginsberg
*Assistant Examiner* — Joshua Lee
(74) *Attorney, Agent, or Firm* — Jaeckle Fleischmann & Mugel, LLP

(57) ABSTRACT

The present invention is a safety device and method of use that comprises a generally round eccentric disk having a peripheral edge and central rotation axis. The generally round eccentric disk has a barbell access slot extending from the peripheral edge to a seat. A cam lobe is formed with a support base adjacent the cam lobe and opposite the central rotation axis from the barbell access slot. The distance is from the peripheral edge adjacent the slot to the seat is greater than the radius of the barbell weights. Rolling the peripheral edge to orient the cam lobe beneath the seat lifts the barbell above the ground.

6 Claims, 7 Drawing Sheets

19
18
14
14
10
34
34
32
32
16
12
27
26
32
32
34
34
14
20
20
30
28
14
29
4

18
34
34
8
6
14
27
26
14
20
20
4
28
29

SAFETY DEVICE FOR LIFTING AND SUPPORTING BARBELLS

RELATED APPLICATION

This application claims the benefit of U.S. Provisional Application No. 61/620,237, filed on Apr. 4, 2012. The entire teachings of the above application are incorporated herein by reference.

BACKGROUND OF THE INVENTION

1. Field of the Invention

The present invention relates generally to safety devices for lifting and supporting barbells.

2. Description of Background Art

Power lifting, competitive weightlifting and other free weight lifting sports require lifting large amounts of weight from a barbell located on the floor. Weights are adjusted during training and competition frequently. The changing of weights can be tedious, require the assistance of two individuals or at least some device to help change weights.

To add and remove the weight effectively, the bar needs to be supported in a somewhat elevated position so that the weights can be slid off the end of the barbell without scraping along the floor. Weights are often in excess of 400 lbs. While athletes are strong individuals, capable of lifting the bar, the athletes can be very fatigued during a workout or competition. Furthermore, it is desirable, that the athlete expend their energy during the workout on the specific exercises and not on changing weights. So a device that assists in raising the barbell for changing weights is of great advantage. Furthermore, to facilitate removal of the weight by a single individual, it would be desirable if the device were capable of supporting the barbell in an elevated position.

Safety concerns demand the barbells be supported in a stable manner so that the barbell does not fall off the device when the weights are being removed. Stability in a direction axial to the bar is important to prevent the device from collapsing when a force is exerted to remove the individual weights off the end and to put the individual weights on the ends of the barbell. Likewise, stability in a direction perpendicular to the barbell is needed so the barbell doesn't fall over on someone.

U.S. Pat. No. 3,771,785 (Speyer I) and U.S. Pat. No. 3,825,253 (Speyer II) disclose a weight adapted for mounting on a bar that has a circular shaped and centrally disposed, axially aligned bore formed therein. It includes wall defining a radial slot from the bore to the periphery. The radial slot allows the weight to be mounted and removed without removing the collar or weight retaining device. Rather than lift the barbell, the weights can slide on or off through a slot. However, these weights are not regulation size. While they can be used during a workout, there is still a need for a device that can be used on barbells that are rounded with a radially central hole through which the weight is placed on the bar.

U.S. Pat. No. 5,839,997 (Roth) discloses a weight lifting apparatus including a plurality of weights each having a central hole and a slot extending from the central hole to the perimeter of the associated weight. Roth does not solve any of the problems of the present invention as it pertains to regulation weights. It is not a device for elevating a bar and stabilizing it in an elevated position.

U.S. Pat. No. 7,534,199 (Krull) discloses an exercise dumbbell that is square shaped with rounded corners. The square shape prevents the weights from rolling along the ground and provides stability. Krull does not solve any of the problems of the present invention as it pertains to regulation weights. It is not a device for elevating a bar and stabilizing it in an elevated position.

U.S. Design Pat. No. D610,636 (Goelish): The Goelish design patent discloses a weight set with a flattened portion to permit stability. The individual weights appear to have a slot from the center to the end to mount the weight onto the bar in a direction perpendicular to the bar.

U.S. Design Pat. No. D617,854 (Gettle) also discloses the design of a barbell that has a slot from the perimeter of the weight to the center. The barbell is eccentric and has a flattened portion on which the barbell can rest with greater stability to prevent rolling. Stability is obtained by having a portion of the weight flattened to prevent rolling.

U.S. Pat. No. 7,637,852 (Hoole I) and U.S. Pat. No. 7,674,208 (Hoole II) both disclose a device that was intended to elevate a barbell with weights and hold the barbell in a stable elevated position so weights can be removed and replaced. The barbell seat is tapered in a laterally outward direction so that the weights that are closest to the middle of the bar rest on the higher part of the seat. The barbell weights that are further from the middle of the bar are elevated and can be removed. The device is bulky. The weights must be rolled up the ramp requiring considerable effort. If released, the barbell can be caused to roll along the floor and injure someone. It would be advantageous if there was a device that is relatively more portable and lightweight. Furthermore, not all of the weights are elevated off the ground. At least one weight is in a supportive position. Moreover, it would be desirable if there was an assistance device that uses leverage to make the rolling and lifting of the bar easier.

U.S. Patent Publication No. 2011/0183818 (Mitchell): The Mitchell application discloses a device intended to elevate a barbell so that the weights can be removed. Mitchell teaches a barbell support comprising an elongated leverage handle that is affixed to at least one pivot foot. The Mitchell device has a cradle mounted on the pivot foot or the handle. The barbell is placed in the cradle with the pivot foot against the ground. The leverage handle is manipulated to raise the cradle relative to the pivot foot and elevate the cradle and barbell above the ground. Optionally, a wheel can be mounted at the pivot foot to transport the barbell from one location to another in the same manner that a dolly lifts and transfers a box. The device, while handy and makes lifting easy, is relatively heavy and bulky. It would be desirable to have a device that was more compact and lightweight. It would be considerable more desirable, if the device is capable of being fitted in a standard sized duffle bag or equipment bag.

Nonetheless, there still exists a need for a device that can elevate a barbell containing very heavy weights off of the floor and support the barbell in a stable position so that the stand does not capsize during removal of the weights. It would be desirable if the device were lightweight and compact. Advantageously, it would be capable of fitting in a suitcases, duffle bag or equipment bag. One or more embodiments of the present invention address these and other needs.

SUMMARY OF THE INVENTION

The present invention is a safety device for lifting a barbell loaded with barbell weights for safe removal of the barbell weights. The device can elevate a barbell containing very heavy weights off of the floor. The device can lift significant weights with a small fraction of a force by rotating the device to gradually rotate a cam lobe on the device underneath the barbell thereby lifting the barbell. It serves as a barbell stand and will support the barbell in a stable position so that the barbell does not capsize during removal of the weights. The device is lightweight and compact—weighing less than five pounds, preferably less than two pounds and most preferably less than one pound. It is capable of fitting in a suitcase, duffle bag or equipment bag.

The safety device of one embodiment is configured to raise and support a barbell above the floor for addition to or removal from the barbell of barbell weights having a barbell radius. The safety device comprises an eccentric disk having a peripheral edge, a central rotation axis and a cam lobe. The eccentric disk is rotatable from a first position to a second position. The barbell is received onto the safety device in a first position. The safety device has an access slot extending from the peripheral edge to the central rotation axis configured to receive the bar of the barbell in a first position. A support base is configured to support the eccentric disk in the second position. The support base is perpendicular to and affixed to the peripheral edge adjacent the cam lobe. It is radially opposite the barbell access slot. There is a first distance from the support base to the seat that is greater than the radius of the barbell weights.

The safety device of one embodiment comprises a seat adjacent the rotation axis radially aligned with the cam lobe and the support base. The support base is configured to support the barbell above the level of the floor when the cam lift is rotated to the second position.

In one embodiment, the support base has a generally flat surface that conforms to the floor and prevents rolling.

In another embodiment, the support base extends perpendicularly outward from the disk.

In still another embodiment, the support base has one or more reinforcing buttresses extending from the support base to the disk.

In an embodiment, the cam lift has a total weight that is less than five pounds.

Preferably, the cam lift is made of molded plastic. Optionally, the cam lift is made of wood or a composite material.

In one embodiment, the safety device further comprises holes in the disk defining a grip handle between the peripheral edge and holes.

In one embodiment, there is a method of changing the weights on a barbell. The method comprises providing a safety device according to one or more of the embodiments disclosed herein. The barbell is then slid into the slot of the device. Next, the device is rotated or rolled to orient the cam lobe in a downward position to lift the barbell. The barbell is removed from the device by rotating or rolling the device to a position other than a downward position and sliding the device off the barbell.

In one embodiment, the support base has a generally flat surface that conforms to the floor and prevents rolling, wherein the step of rotating positions the generally flat surface on the floor.

The support base, of one embodiment, extends perpendicularly outward from the disk. After the step of rolling, the base resists tipping when the weight is pulled from or mounted onto the barbell. The support base, typically, has one or more buttresses extending from the support base to the disk.

The present invention, including its one or more embodiments, can be better understood with reference to the following drawings, detailed description and examples, which are included to teach the invention without limiting the scope of the invention.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

Figure 1:
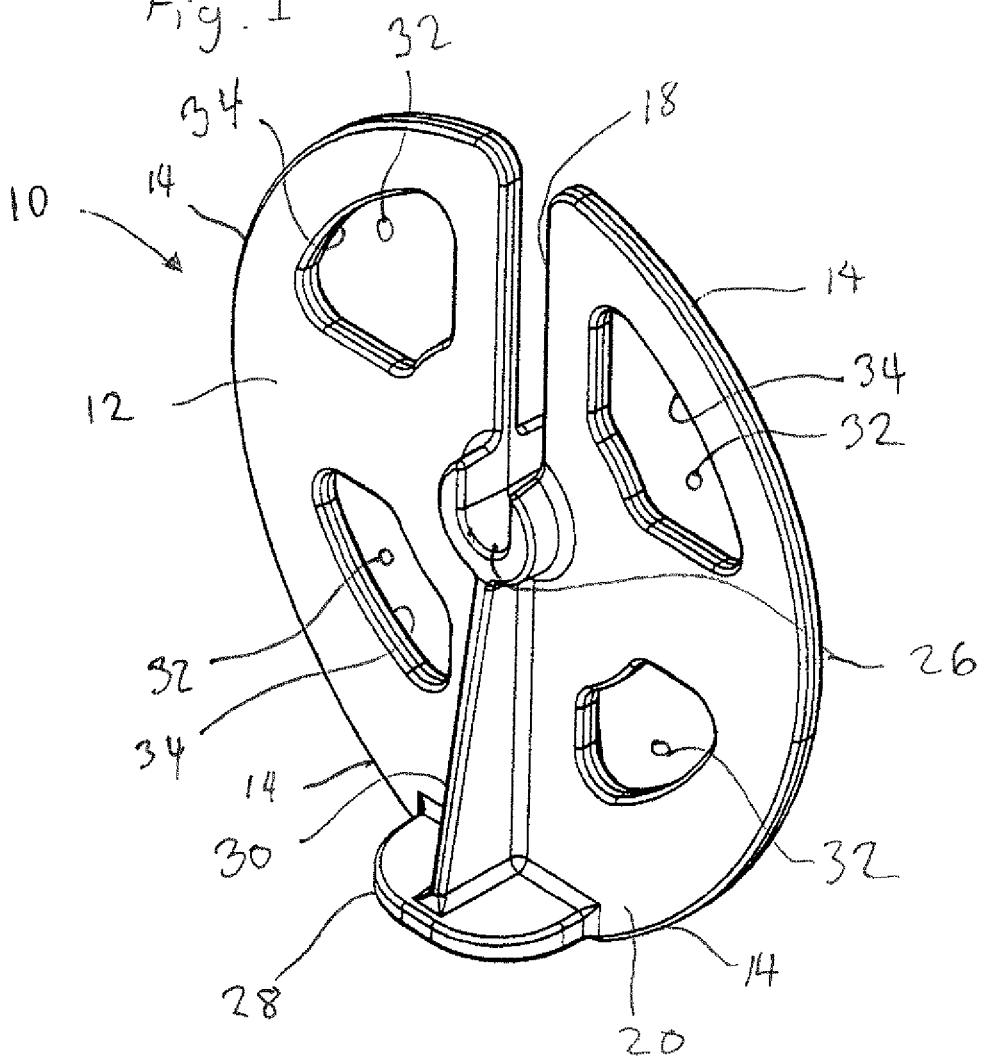
FIG. 1 is a perspective view of the safety lifting device of one embodiment.

A description of example embodiments of the invention follows.

The present invention is described with reference to FIGS. 1 to 4 describing a safety device 10 of one embodiment. The safety device 10 of one embodiment is also referred to as a cam lift 10 is configured to raise and support a barbell 5 (see FIGS. 5-8) above the floor 4 for addition to or removal from the barbell 5 of barbell weights 8. The safety device 10 also referred to as a cam lift 10 comprises an eccentric disk 12 that has a peripheral edge 14, a central rotation axis 16 and a cam lobe 20.

Figure 2:
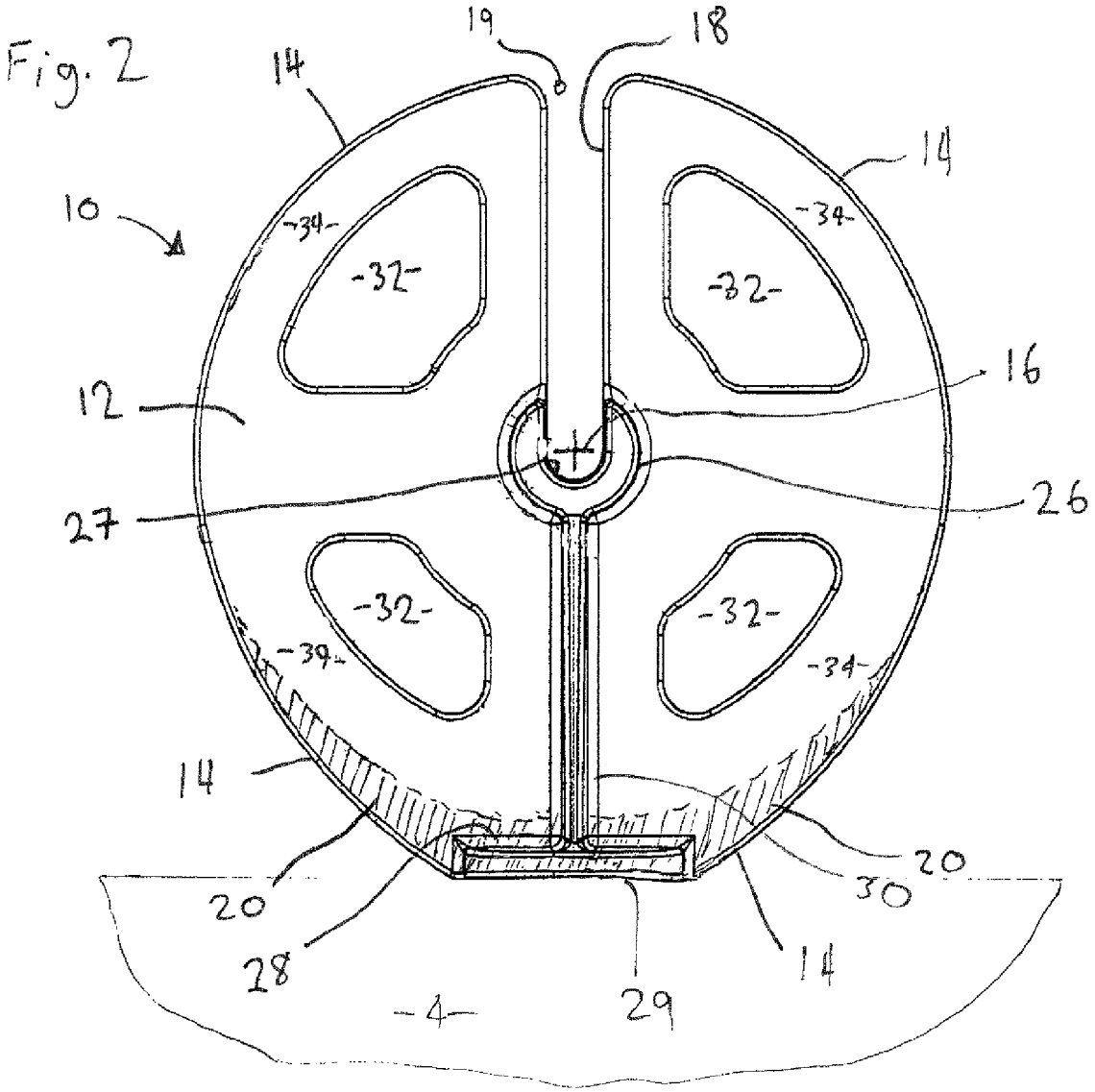
FIG. 2 is a side elevated view of the safety lifting device of FIG. 1.
Figure 6:
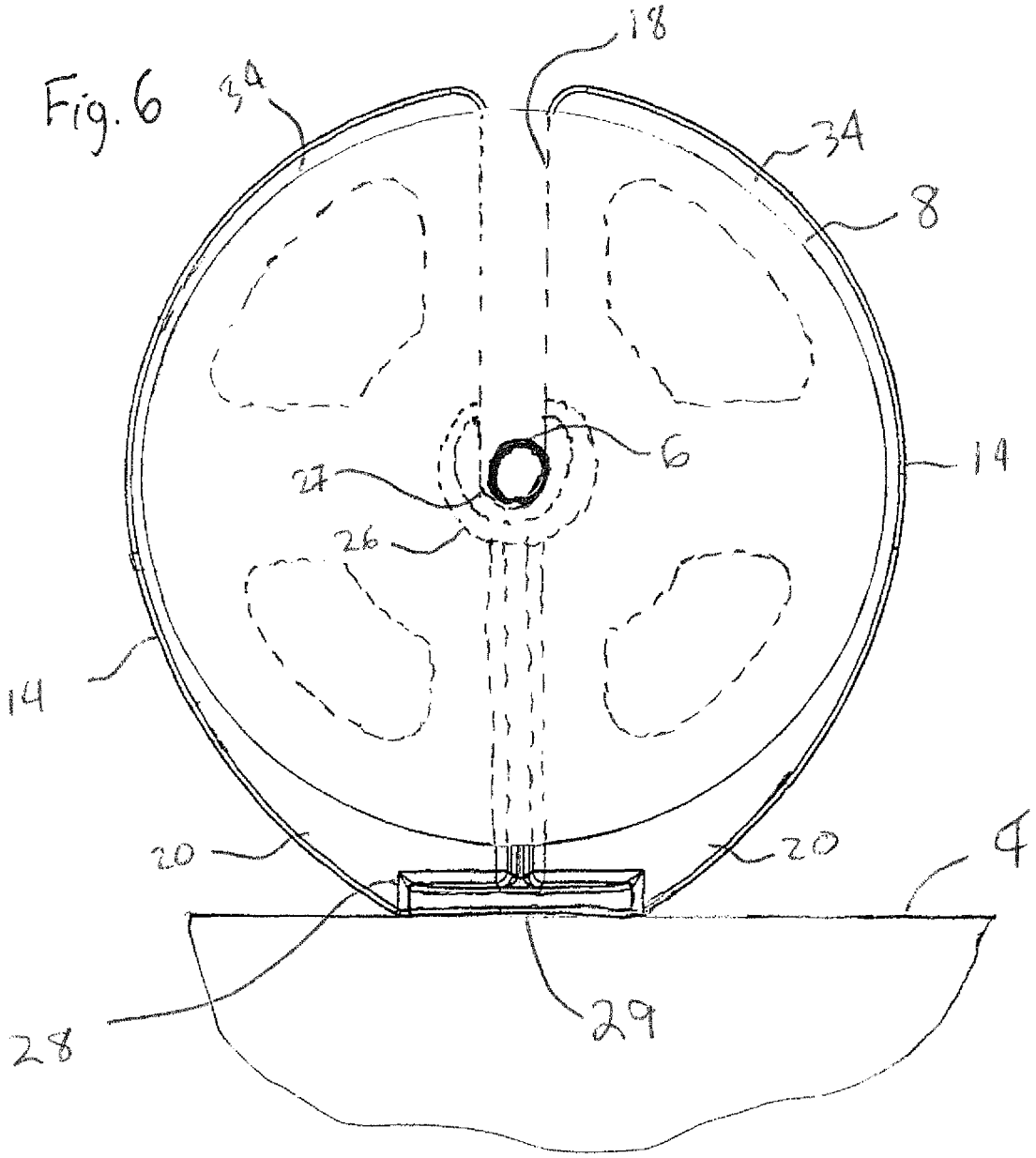
FIG. 6 shows a side view of one embodiment of the present invention in second position supporting the barbell.

With continued reference to FIG. 1, attention is directed to FIGS. 2 and 6 showing the shaded portion of the eccentric disk 12 defining the cam lobe 20. The eccentric disk 12 has a central axis 16 and a primary radius extending from the central axis to the peripheral edge 14 along the portion of the peripheral edge 14 that does not form the cam lobe 20. The primary radius, in one embodiment, is selected to be about the radius of the largest weight 8 to be lifted by the cam lift 10. In one embodiment, the radius of the largest weight 8 to be lifted is slightly larger than the primary radius. The eccentric disk 12 has a plurality of holes forming gripping handles 34. This decreases the overall weight and provides improved functionality.

The cam lift 10 being generally round is rotatable from a first position to a second position. The first position is any position where the cam lift 10 is placed over the barbell 5 by sliding the bar 6 of the barbell 5 onto the cam lift 10. The second position is the position where the cam lift 10 supports the barbell 5 elevated above the floor 4 for easy access to add or remove the weights. The cam lift 10 is placed on the barbell 5 in a first position via an access slot 18 extending from a mouth 19 of the access slot 18 at the peripheral edge 14 to a seat 27 adjacent the central rotation axis 16.

Figure 3:
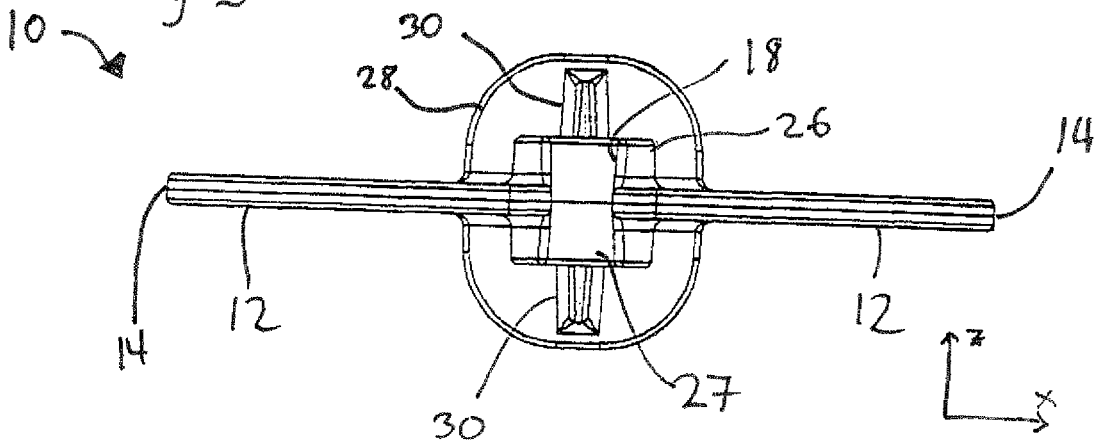
FIG. 3 is a top view of the safety lifting device of FIG. 2.
Figure 4:
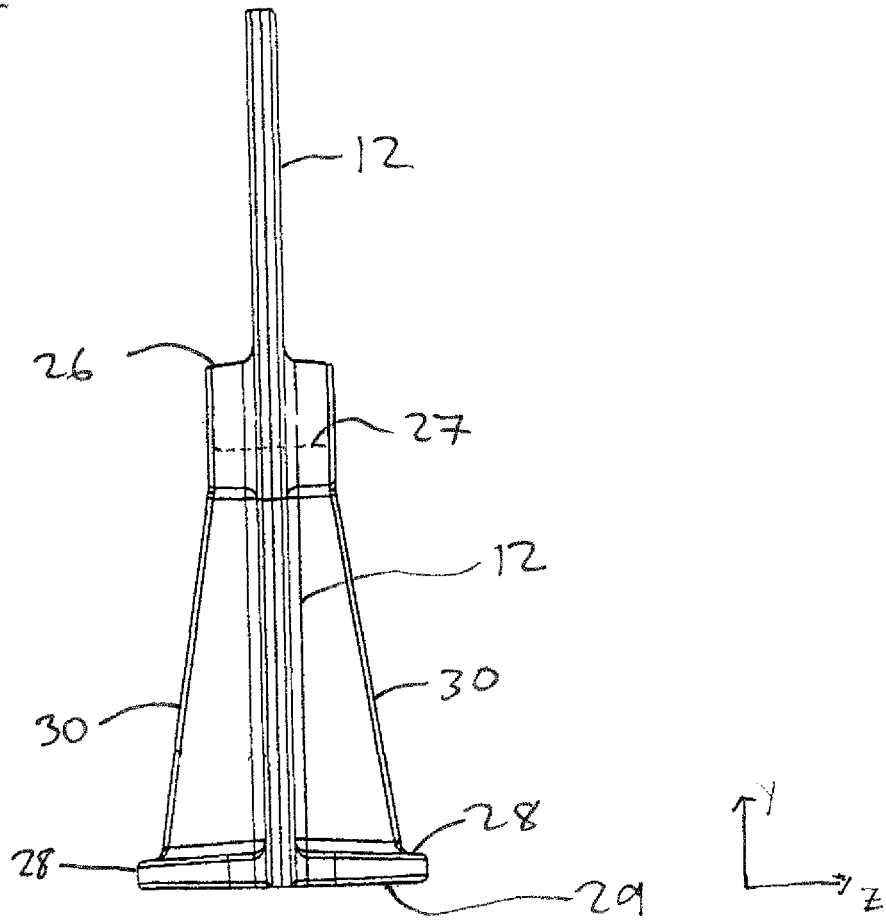
FIG. 4 is a side elevated view of the device of FIG. 2 taken along the lines 4-4.
Figure 8:
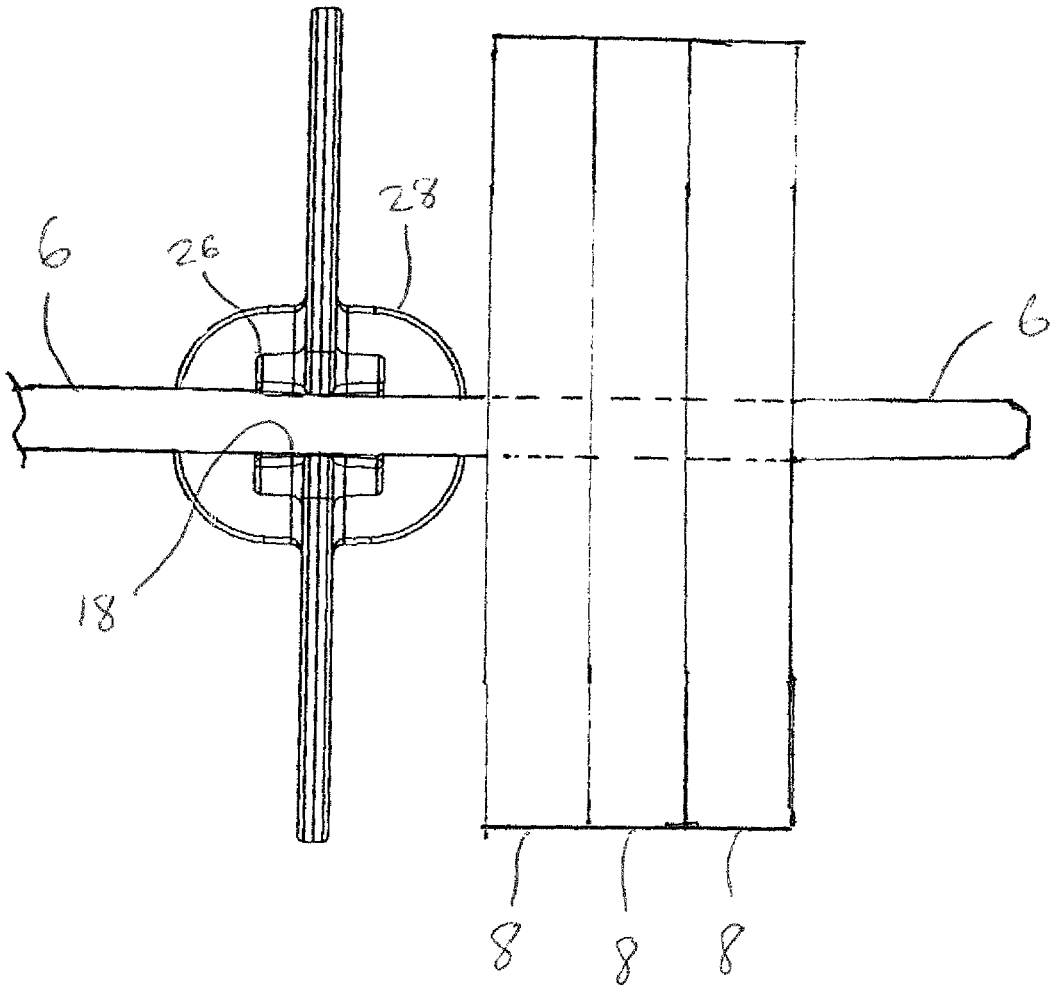
FIG. 8 shows a top view of one embodiment of the present invention supporting a barbell in the second position.

With reference to FIGS. 3 and 8, the support base 28 is configured to support the eccentric disk 14 in the second position. The support base 28 is perpendicular to the access slot 18. The support base 28 is affixed to the peripheral edge 14 adjacent the cam lobe 20. As shown in FIGS. 2 and 6, the support base 28 is flat so that it functions as a stand. Accordingly, the support base 28 is preferably has a flat surface 29 on the bottom side of the support base 28 that is sufficient to impart the desired stability. The support base 28 is radially opposite the mouth 19 of the access slot 18. There is a first distance from the seat 27 adjacent the central rotation axis 16 to the support base 28 that is greater than the radius of the largest barbell weights 8 that the cam lift 10 is designed to lift.

As shown in FIG. 1, with reference to FIGS. 3, 4, 7 and 8, the seat 27 of the cam lift 10 receives and supports the bar 6 of the barbell 5. It is fitted with a support collar 26. That preferably increases the overall width of the seat 27 by a minimum of twice the thickness of the eccentric disk 12, preferably three times the width. In one embodiment the eccentric disk 12 is about ¾ of an inch thick. The collar 26 is preferably about ¾ inch thick on both sides of the eccentric disk 12 increasing the thickness of the seat 27 to about 2¼ inches thick. The additional thickness provides added support strength to the cam lift 10 while minimizing the overall weight of the cam lift 10. The collar 26 allows the cam lift 10 to support greater weight without overall thickening the eccentric disk 12.

The access slot 18, the seat 27 and the central axis 16 are radially aligned with the cam lobe 20 and the support base 28. The support base 28 having a bottom flat surface 29 supports the barbell 5 and the barbell weights 8 above the level of the floor 4 when the cam lift 10 is rotated to the second position supporting the barbell as a barbell stand.

Orientation of the cam lift 10 can be describe best with reference to a three dimensional grid having an x-axis, a y-axis and a z-axis. The x- and z-axis are horizontal, extend perpendicular to one another with the y-axis extending vertical and perpendicular to both the x axis and z axis. For the sake of relative orientation of the parts and without limitation, the support base 28 has a generally flat surface 29 that is horizontal when the cam lift 10 is positioned in the second position where the cam lift 10 functions as a stand. The eccentric disk 12 is aligned along the x-axis and stand vertical with the access slot 18, seat 27 and central axis 16 extending perpendicular to and centered above the stand in the second position.

With particular reference to FIGS. 3, 4, 7 and 8, the support base 28 is flat in the direction of the x-axis to provide a stable base when the cam lift 10 is rotated by rolling into the second position for supporting the barbell 5. It extends outward in the direction of the z-axis perpendicular to the eccentric disk 12. Buttresses 30 extend on both sides in the direction of the z-axis from the support base to the collar 26. The collar 26 and seat 27 are centered directly above the support base 29 for greater stability.

The flat surface 29 conforms to the floor 4 and prevents rolling. Preferably the support base 28 is sufficiently large to not only support the barbell 5 but stabilize the cam lift 10 when in the second position supporting the barbell 5 and functioning as a stand for the weights. The cam lift 10 can be knocked over by being rolled off the flat surface 29 of the support base 28 in a direction perpendicular to the barbell (x-direction). Thus, the base 28 and its flat surface 29 is sufficiently large (in the direction of the x-axis) to prevent it from being tipped over easily. In one embodiment, the base 28 (in the direction of the x-axis) is a minimum of 0.3 times the distance from the seat 27 to the flat surface 29, preferably a minimum of 0.4 times the distance from the seat 27 to the flat surface 29. Most preferably the base 28 (in the direction of the x-axis) is a minimum of 0.5 times the distance from the seat 27 to the flat surface 29. On the other hand, if the support base 28 is too large in the x-direction is will lose the feature of being able to smoothly rotate the cam lift 10 into the second position.

As noted, the support base 28 extends perpendicularly outward from the disk (in the direction of the z-axis). This prevents the cam lift 10 from tipping over due to movement of the barbell 5 in the direction of the axis of the bar 6. Thus, the base 28 and its flat surface 29 is sufficiently large (in the direction of the z-axis) to prevent it from being tipped over easily due to movement of the barbell 5 in the direction of the axis of the bar 6. In one embodiment, the base 28 (in the direction of the z-axis) is a minimum of 0.3 times the distance from the seat 27 to the flat surface 29, preferably a minimum of 0.4 times the distance from the seat 27 to the flat surface 29. Most preferably the base 28 (in the direction of the z-axis) is a minimum of 0.5 times the distance from the seat 27 to the flat surface 29.

In an embodiment, the cam lift 10 has a total weight that is less than five pounds, preferably less than 4 pounds, more preferably less than 3 pounds, most preferably less than 2 pounds. The height of the cam lift 10 is preferably no more than 1.10 of the diameter of the largest weight 8 it is designed to lift.

In one embodiment, the cam lift 10 is made of wood, oriented strand board or high density fiberboard. In another embodiment, the cam lift 10 is made of molded plastic.

Figure 5:
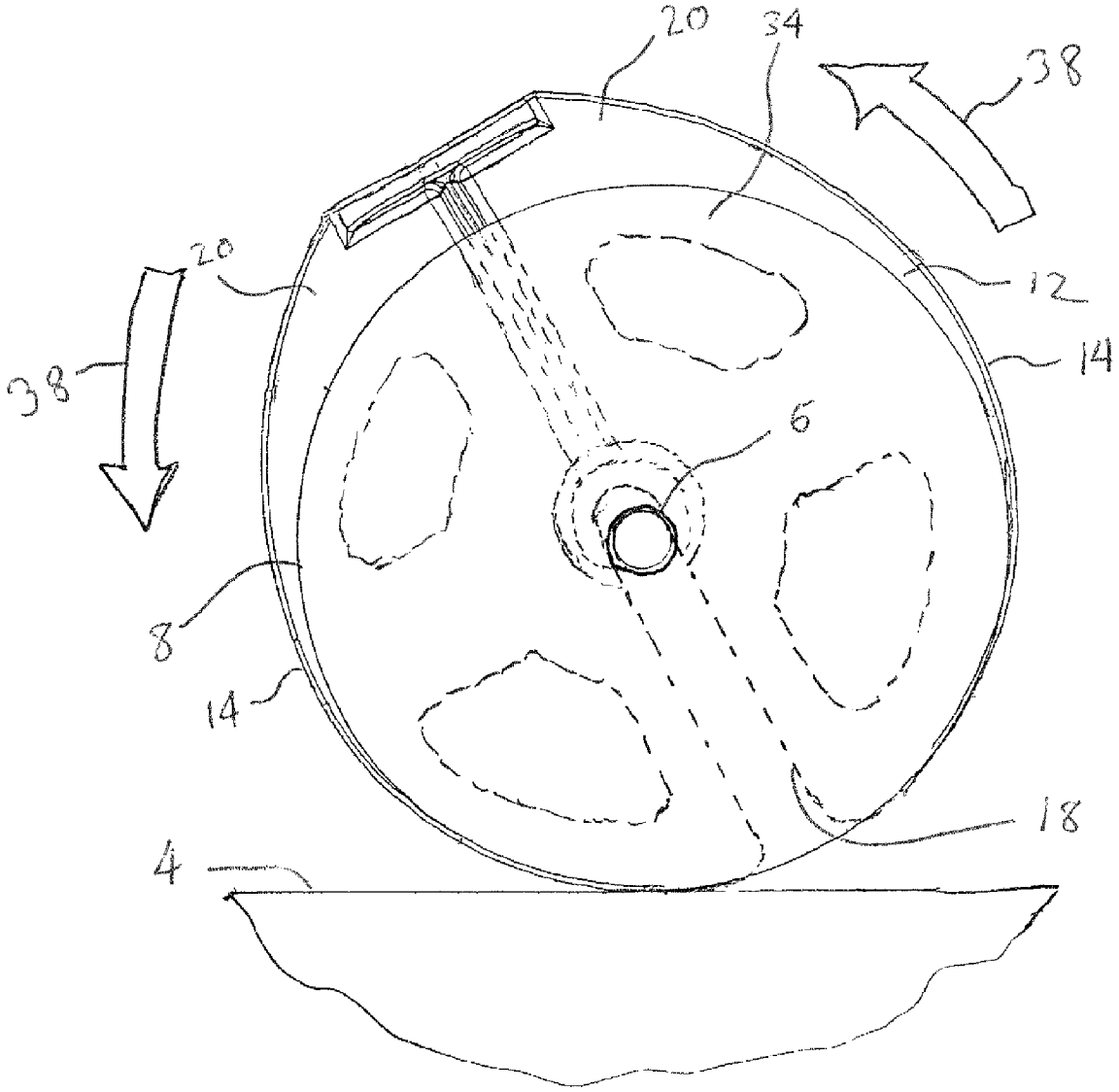
FIG. 5 shows a side view of one embodiment of the present invention being placed on a barbell showing the method of use of the safety lifting device.
Figure 7:
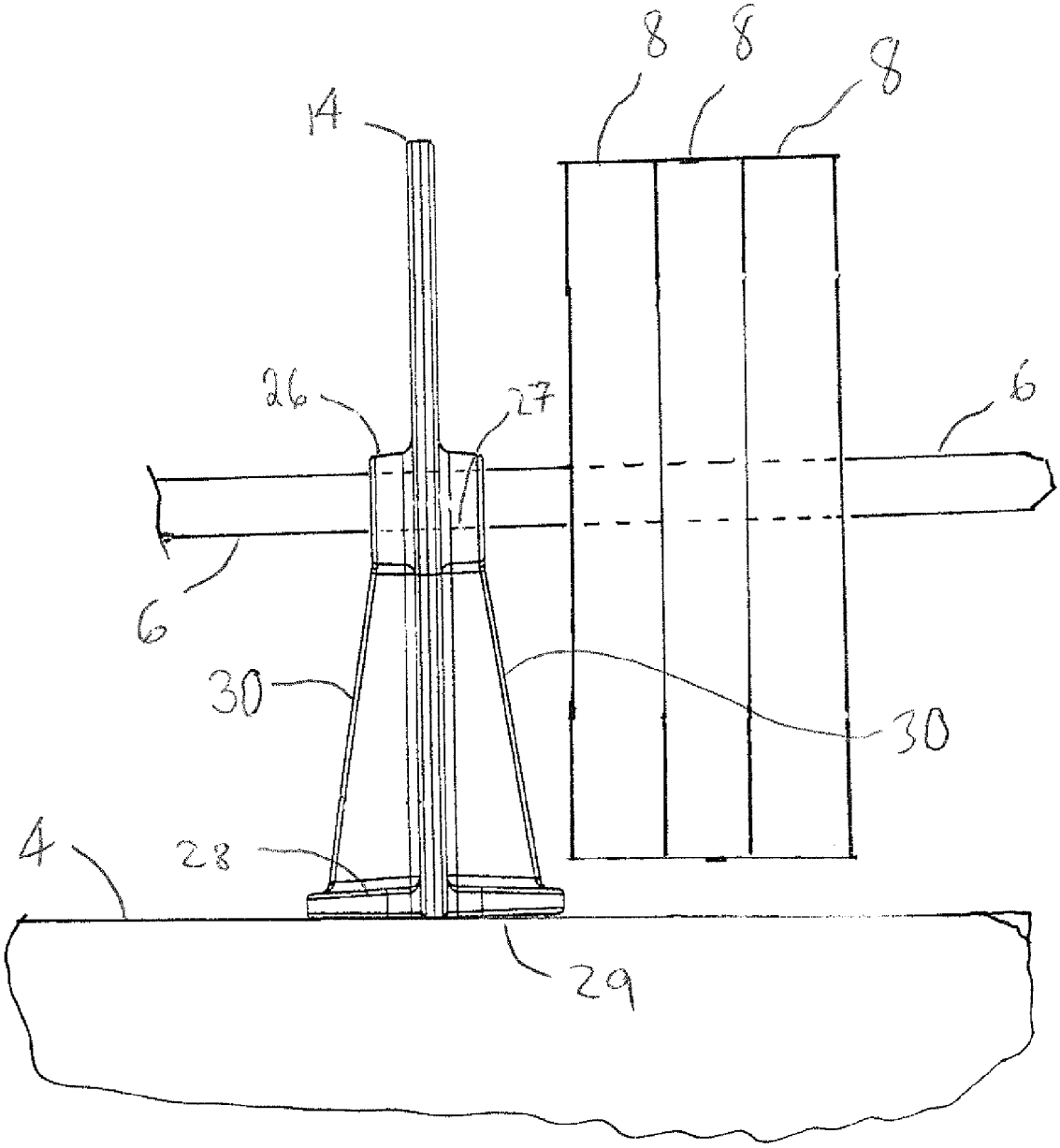
FIG. 7 shows an end view of one embodiment of the present invention in a second position supporting a barbell.

The use of the cam lift 10 is described with reference to FIG. 5. A cam lift 10 is provided according to one or more embodiments of the present invention. The cam lift 10 is placed over the bar 6 of the barbell 5 by sliding the bar 6 into the access slot 18 of the cam lift 10. Next, the cam lift 10 is rotated as shown by direction arrows 38 by rolling the cam lift 10 to orient the cam lobe 20 in a downward position as illustrated in FIG. 6. This rotation gently lifts the barbell 5 as the peripheral edge 14 in the area of the cam lobe 20 is rotated under the bar 6 to lift the barbell 5. Further rotation positions the support base 12 centered under the seat 27 and forms a stable stand as shown in FIGS. 6, 7 and 8. In this position, the support base 28 has a generally flat surface 29 that conforms to the floor 4 and prevents rolling. Because the distance between the seat 27 and the top of the support base 28 is greater than the radius of the weights 8 of the barbell, the barbells are lifted off the ground.

The support base 28, of one embodiment, extends perpendicularly outward from the eccentric disk 12. After the step of rolling, the base 28 resists tipping when the weight is pulled from or mounted onto the barbell. The support base 28, typically, has one or more buttresses extending from the support base 28 to the disk 12. The cam lift 10 can be removed from the barbell 5 by rolling the cam lift 10 from the base 28 and sliding the cam lift 10 off the bar 6.

The present invention, including its one or more embodiments, can be better understood with reference to the following drawings, detailed description and examples, which are included to teach the invention without limiting the scope of the invention.

What is claimed is:

1. A method of changing the weights on a barbell comprising:

providing a safety device comprising:

an eccentric disk having a peripheral edge, a central rotation axis and a cam lobe, wherein the eccentric disk is rotatable from a first position to a second position;

an access slot extending from the peripheral edge to the central rotation axis configured to receive a bar of a barbell in the first position;

a support base configured to support the eccentric disk in the second position, the support base being perpendicular to and affixed to the peripheral edge adjacent the cam lobe and radially opposite the barbell access slot, and having reinforcing buttresses on both sides of the disk extending from the support base to the disk; and a seat adjacent the rotation axis radially aligned with the cam lobe and the support base, wherein a first distance from the seat to the support base is greater than the radius of the barbell weights and wherein the support base is configured to support the barbell above the level of the floor when the safety device is rotated to the second position;

sliding the barbell into the access slot; and rotating the safety device to orient the cam lobe in a downward position to lift the barbell, wherein, the support base has a generally flat surface that conforms to the floor and prevents rolling, and wherein rotating the safety device includes positioning the generally flat surface on the floor.

2. The method of claim 1, wherein the support base extends perpendicularly outward from the disk, and wherein the support base resists tipping when the weight is pulled from or mounted onto the barbell.

3. The method of claim 1, wherein the safety device has a total weight that is less than five pounds.

4. The method of claim 1, wherein the safety device is made of molded plastic.

5. The method of claim 1, wherein the safety device is made of wood.

6. The method of claim 1, further comprising:

rotating the device to orient the cam lobe in a position other than the downward position.

* * * * *